343-754
1/4/77 SR
OR 4,001,834

United States Patent [19]
Smith

[11] 4,001,834
[45] Jan. 4, 1977

[54] PRINTED WIRING ANTENNA AND ARRAYS FABRICATED THEREOF

[75] Inventor: Terry M. Smith, La Honda, Calif.

[73] Assignee: Aeronutronic Ford Corporation (formerly Philco-Ford Corporation), Blue Bell, Pa.

[22] Filed: Apr. 8, 1975

[21] Appl. No.: 566,607

[52] U.S. Cl. ..... 343/754; 343/795; 333/84 M

[51] Int. Cl.[2] ..... H01Q 9/28

[58] Field of Search ..... 343/795, 797, 846, 908, 343/754, 821, 822, 767, 789, 770, 860; 333/84 L, 84 M

[56] References Cited

UNITED STATES PATENTS

| | | | |
|---|---|---|---|
| 3,750,185 | 7/1973 | Evans | 343/821 |
| 3,836,976 | 9/1974 | Monser et al. | 343/797 |

*Primary Examiner*—Alfred E. Smith
*Assistant Examiner*—Tommy P. Chin
*Attorney, Agent, or Firm*—Robert D. Sanborn

[57] ABSTRACT

A form of printed wiring antenna with integral transmission feed line is disclosed and a passive repeater using the antenna is shown printed onto a single printed wiring card. An array of such cards can be fabricated into a radiant energy lens. The character of the lens is determined by the physical dimensions of the printed wiring cards and the electrical length of the printed transmission lines.

9 Claims, 12 Drawing Figures

PRINTED WIRING ANTENNA AND ARRAYS FABRICATED THEREOF

BACKGROUND OF THE INVENTION

For point to point communication, narrow beam or so called "pencil beam" antennas are desirable because they confine their radiated energy into a small area and thereby waste less energy than conventional antennas. In a communications system, as antenna beamwidth is reduced, less power is required to achieve a suitable signal level at the remote receiver. However as antennas are constructed to produce narrower beams, their size and complexity increase. One way that has been developed to reduce antenna beam width is to construct an antenna of moderate beamwidth and then place a radiant energy lens in front of it. A suitably designed lens can focus the antenna beam into almost any desired shape. The antenna itself need only have a beamwidth that adequately illuminates the lens.

Focusing lenses for radio wavelengths have been constructed from dielectric materials, metal strips and plates, and combinations thereof. Another form of lens has been constructed by forming a surface comprising a large number of simple antennas in a planar array having a predetermined shape. The antennas are connected on a one to one relationship with a similar array oppositely faced. The electrical length of all the interconnections can be made the same, or used as a variable parameter, and the shape of the antenna array surface formed into a suitable configuration. Alternatively the array surfaces can be made flat or planar and the length of the interconnection elements varied to give the desired electrical effect. In addition both the surface contour and the variable interconnection line length can be employed simultaneously to give almost any desired lens action. For example a plano to concave or convex surface can be used or concave to convex of reasonable curvature can be achieved. It has been found that such lenses can be designed to enhance either the beamwidth or reduce sidelobe intensity of an antenna. In fact beamwidth reductions along with reduced side lobes have been accomplished. Additionally a lens can be used to either increase or decrease as desired an antenna lobe scanning angle.

Still further it has been found that a single lens can be used to improve the performance of a plurality of separate antennas used to communicate with a plurality of divergent remote locations. This latter aspect is of great importance in satellites. When a satellite is to be used to communicate with a number of widely separated ground stations, a narrow antenna beam cannot be used to cover all locations simultaneously. More desirably one antenna can be used for each ground station and a very narrow beam can be employed for each thereby greatly reducing the power required. In addition such a system admits of separate communications to each ground station using multiple feeds and a common lens aperture with good isolation therebetween.

in the terms of a synchronous satellite, the earth subtends an angle of about 18°. Designing a single lens that will cover such an angle for use with a plurality of separate feed antennas is quite feasible and such a system has the advantage of reduced weight.

Unfortunately the problems of constructing arrays of interconnected antennas by conventional means are formidable. The simple antennas themselves are a problem to make and mount and the interconnecting elements pose a problem in maintaining the required signal delay (or electrical length) along with reliable and easily established connections.

SUMMARY OF THE INVENTION

It is an object of the invention to construct a broadband antenna and feed transmission line on a printed wiring card.

It is a further object of the invention to construct a passive radiant energy repeater by fabricating two antennas and an interconnecting transmission line on a common printed wiring card.

It is a still further object of the invention to construct a radiant energy lens by assembling a plurality of printed wiring cards in to a three dimensional structure wherein each card has printed thereon oppositely radiating antennas and an interconnecting transmission line of predetermined electrical length.

These and other objects are achieved by employing the following elements as described. A novel printed wiring antenna and transmission line assembly is fabricated on a single printed wiring substrate. On one side of the substrate a large area ground plane conductor is established. A tapered notch is located in the conductor so that the maximum divergence of the taper occurs at the edge of the substrate and is the same width as the substrate. The maximum divergence is made about one electrical wavelength at the frequency at which the antenna is meant to operate. If r-f energy is applied across the notch the tapered edges of the conductor will act to couple the energy to space and thus will act as a broadband antenna. The location of the point at which the connection is made relative to the narrow end of the notch determines the antenna driving impedance. On the other side of the card a microstrip conductor is established to operate as an r-f transmission line against the ground plane. The microstrip passes over the slot and is connected to the metal at one side of the notch by means of capactive coupling. The antenna can be enclosed inside an open faced shield box, the open face of which coincides with the edge of the printed wiring and the position of the maximum notch divergence.

Two such antennas can be printed facing oppositely on a single printed wiring card and the microstrip transmission line used to interconnect them. Such a construction comprises a passive repeater. An array of such repeaters can be assembled into a lens structure wherein the lens action is determined by the relative physical length of cards and by the electrical length of the microstrip transmission lines. If the assembly includes a group of printed wiring antennas mounted at right angles to an equal of antennas, the lens can handle any signal polarization including circular.

DESCRIPTION OF THE INVENTION

Figure 1A:
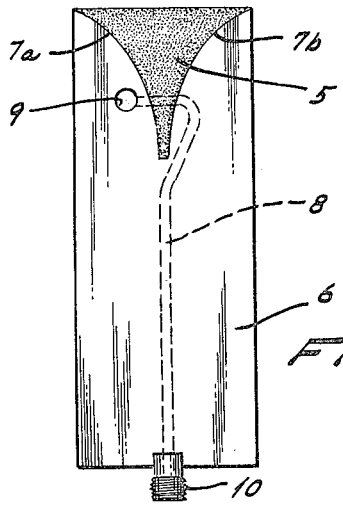
FIG. 1A shows a printed wiring antenna and microstrip transmission line assembly.

FIG. 1A shows the printed wiring antenna of the invention. A suitable printed wiring substrate 5 has printed conductors on both faces thereof. The substrate can be any dielectric with Teflon-fiberglass composite being considered an excellent choice. Copper conductors are laminated to both faces and contoured to provide metal areas of the desired shape by any of several well known techniques. On the side shown in FIG. 1A the metal conductor has a notch located at one end shaped so that the conductors defining the sides of the notch increase in divergence toward the edge of the substrate 5. For reasons which will appear as the description of the invention proceeds, it is preferable that the width of the assembly be approximately equal to the maximum divergence of the notch i.e. so that the conductor edges *7a* and *7b* diverge to the corners of substrate 5. FIG. 1A shows conductor 6 covering most of the surface on one side of the substrate. Conductor 6 is designed to act as a ground plane for microstrip transmission line conductor 8 which is located on the opposite face of substrate 5. Capacitive coupling at 9, which can be in the form of an enlarged end of line 8, connects microstrip line conductor 8 to conductor 6 at a point spaced from the narrow end of the notch in conductor 6. The other end of microstrip line 8 terminates in cable connector 10 which can be a conventional coaxial cable connector having its outer shell connected to the ground plane or conductor 6 and its inner conductor connected to microstrip line conductor 8.

If radio frequency energy is applied from a source, not shown, the energy will be conducted along microstrip line 8 to element 9 which couples to the tapered portion of conductor 6. The tapered portions of conductor 6 produced by the notch will act as an antenna to couple the applied r-f energy to space. The location of coupling 9 along the notch determines the driving impedance and is selected to match the impedance of the microstrip line 8. If the dimension of substrate 5, and hence the divergence of conductor edges *7a* and *7b*, ) is made about one wavelength across at the widest divergence, it has been found that excellent broadband antenna performance is achieved. As the open end of the divergent metal portions is made larger, antenna action will still be present but the radiation pattern will be altered.

Figure 1B:
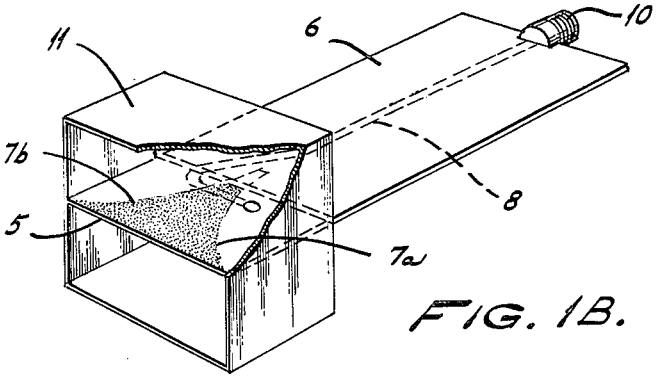
FIG. 1B shows the antenna of FIG. 1A with a shield mounted thereon.

FIG. 1B shows the antenna of FIG. 1A with a conductive shield 11 around the antenna portion of the device. Shield 11 has its open face at the point of greatest notch divergence and its closed face at the other end may have a slot in it just wide enough to accommodate substrate 5 with its metal surfaces. The closed end of shield 11 may be soldered or otherwise joined to the groundplane or conductor region 6 so that tapered edges *7a* and *7b* extend inside shield 11. On the opposite side a notch (not shown) is used to prevent contact to microstrip 8 to avoid shorting. This shield acts to confine the radiation from the antenna in a direction away from the open end, much in the fashion of a horn antenna which the assembly now resembles.

Shield 11 could be round if desired or oval, or some other shape could be used. However, the square form is preferred because it is the ideal shape for stacking a plurality of antennas to form on array. Since shield 11 isolates the antenna, stacking a plurality of such antennas close together can be achieved without adjacent antenna interaction. Such intersection makes designing a plural antenna array very difficult when using ordinary antennas. This difficulity is avoided by using the structure of FIG. 1B.

A very useful feature of the invention is found in the printed wiring approach. It can be seen in FIG. 1A that a fairly large area can be made available for including other additional printed wiring components. For example using conventional hybrid technology a complete transmitter (not shown) and modulator (not shown) could be incorporated onto the surface of groundplane over conductor region 6 and/or the opposite surface of substrate 5. This means that the antenna cards in a multiantenna array could also carry the associated r-f components needed to generate, modulate, and control the output signals.

The antenna depicted is well suited for use in the microwave portion of the radio spectrum where multiple antenna arrays are commonly used. For example at 4GHz the width of the card used in the FIG. 1A antenna would be about 7.5 cm.

The antennas of FIGS. 1A and 1B will produce linearly polarized signals with the electric vector parallel to the surface of substrate 5. If other polarizations are desired, including circular, two such printed wiring antennas of FIG. 1A could be combined at right angles to each other and they could use a common shield box 11 of FIG. 1B. Details of how to do this will be shown below. Thus looking at the end of the assembly of FIG. 1B and a second antenna bisecting shield box 11 across the vertical direction would be seen. In effect crossed dipole action would be present. If two such crossed antennas are fed equal signals in phase quadrature, a circularly polarized signal would be emitted.

Figure 2A:
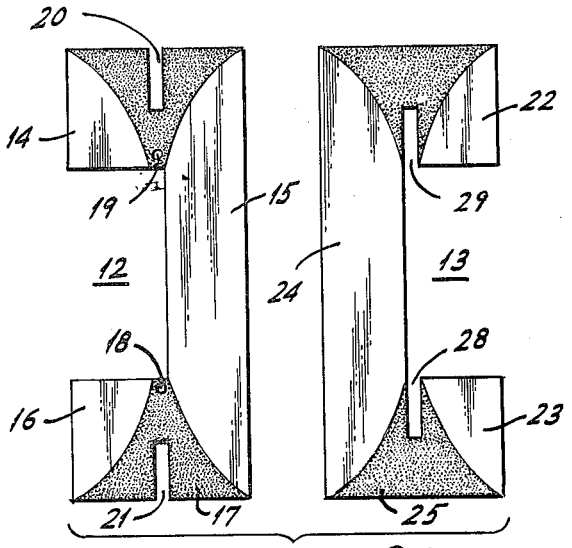
FIG. 2A shows a pair of interconnected antennas on a printed wiring substrate shaped for assembly at a mutual right angle.
Figure 2C:
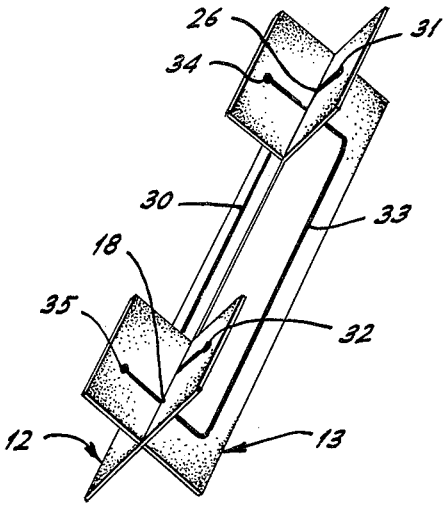
FIG. 2C shows the elements of FIG. 2B assembled.
Figure 2B:
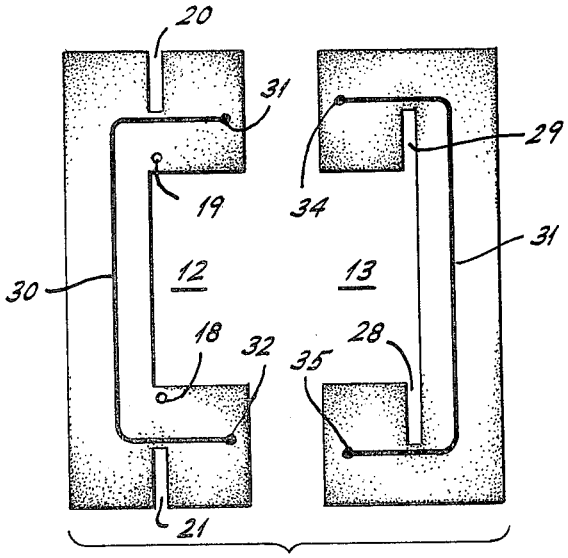
FIG. 2B shows the opposite sides of the FIG. 2A elements.

FIGS. 2A, 2B and 2C show a form of the basic elements of the embodiment of the invention, using two printed wiring cards at right angles. The embodiment-shown FIGS. 2A, 2B and 2C differs from the embodiment of FIGS. 1A and 1B by having antenna elements at both ends of the printed wiring card, thus making it suitable for use as a repeater. Second, the cards are particularly adapted to be assembled at right angles to one another, thus allowing the assembly to receive or radiate signals of any polarization, including circular. In FIG. 2A one side of a pair of printed wiring cards 12 and 13 are shown. Conductor regions 14, 15 and 16 on card 12 are conductive foil on an insulating substrate 17. On card 13 conductor regions 22, 23, and 24 are located on insulating substrate 25. These cards can be made from conventional copper laminated Teflon fiberglass sheet stock. The copper is photolithographically (or otherwise) contoured as shown and the cards shaped as shown. Card 12 has holes at 18 and 19 and slots at 20 and 22. Card 13 slots at 28 and 29.

FIG. 2B shows the reverse sides of cards 12 and 13. Microstrip transmission line conductor 30 runs between printed capacitors 31 and 32 which couple energy to the metal on the opposite side of the card. Thus line 30 which operates against a ground plane formed by conductor region 15 interconnects conductor regions 14 and 16. Similarly card 13 has microstrip transmission line 33 joining conductor regions 22 and 23 by way of capacitive coupling at 34 and 35.

Cards 12 and 13 are assembled at right angles to each other, by flexing the cards and meshing the slots as shown in FIG. 2C. If desired the cards can be epoxy cemented together. A shorted quarter wave cavity is formed by running wires through holes 18 and 19 and soldering them to the metal on each side. This joins the end of metal region 22 to metal region 24 and the end of metal region 23 to metal region 24. This completes a three dimensional repeater array.

Electrically the tapered ends of conductor regions 14 and 15, 15 and 16, 22 and 24 and 23 and 24, respectively, each form an antenna as described in connection with FIG. 1A. If the width of cards 12 and 13 is about one wavelength, each pair forms an efficient broadband radiator element having a broad radiation beam directed outward along the long axis of the cards. This antenna is enhanced if a ground plane is established perpendicular to the cards and located adjacent to the wide portion of conductor regions 14 and 22, and another located at the back of metal regions 16 and 23.

Figure 3:
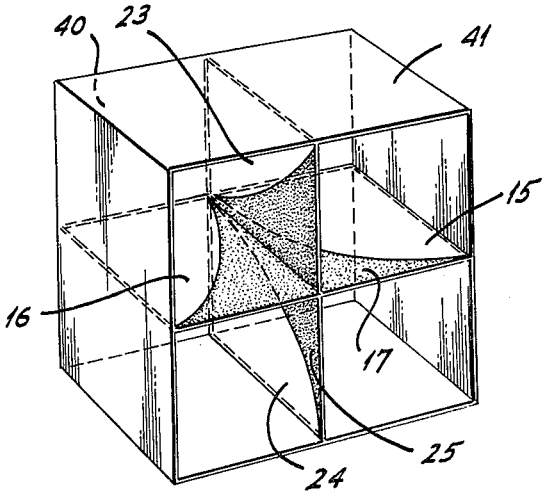
FIG. 3 shows the details at one end of the assembly of FIG. 2C with a shield mounted thereon.

FIG. 3 shows a ground plane shield constructed around one end of the antenna structure of FIG. 2C. The microstrip details have been omitted for clarity. Conductor regions 15 and 16 on substrate 17 comprise one antenna while conductor regions 23 and 24 on substrate 25 comprise an orthogonally polarized antenna. Conducting backplate 40 constitutes the ground plane for the antennas. A conductive box 41 completely encloses the sides of the antennas and shields these antennas from adjacent elements. Preferably shield 41 is electrically joined to backplate 40. The assembly of FIG. 3, as applied to the cards illustrated in FIG. 2C, would appear at each end. Such an assembly would constitute two oppositely pointed antennas capable of responding to r-f energy of any polarization, including circular, and connected together by microstrip transmission lines. In effect a radiant energy repeater is present having a phase delay dependent upon the electrical length of the transmission lines.

The shape of the elements described in FIGS. 1B, 2C and 3 is such that a plurality of such elements can be stacked together to form a lens array. For example one hundred such units can be stacked in an array of ten by ten to form a square array. If all of the cells of the elements were made the same, any input beam to one face of such an array would simply be repeated out of the other face. However, if the microstrip transmission line interconnections are made to have different delay values and the delays varied in a regular manner across the face of the array, a lens action can be obtained.

It is an easy matter to vary the delay of the microstrip lines. For example a slab of ferrite can be cemented over lines 30 and 33 of FIG. 2B, to increase the delay interval between antennas. The delay would be a function of how much of the line is covered and the permeability of the ferrite. If desired the ferrite could also be used as the printed wiring substrate. If ferrite were to be used it could be overwound with a coil of wire (not shown) through which a control current could be passed to permit control of the delay where such control is desired feature. For example, with a fixed input beam the output beam could be steered or scanned by varying the respective microstrip transmission line delay value in accordance with a preselected program.

Figures 4A, 4B:
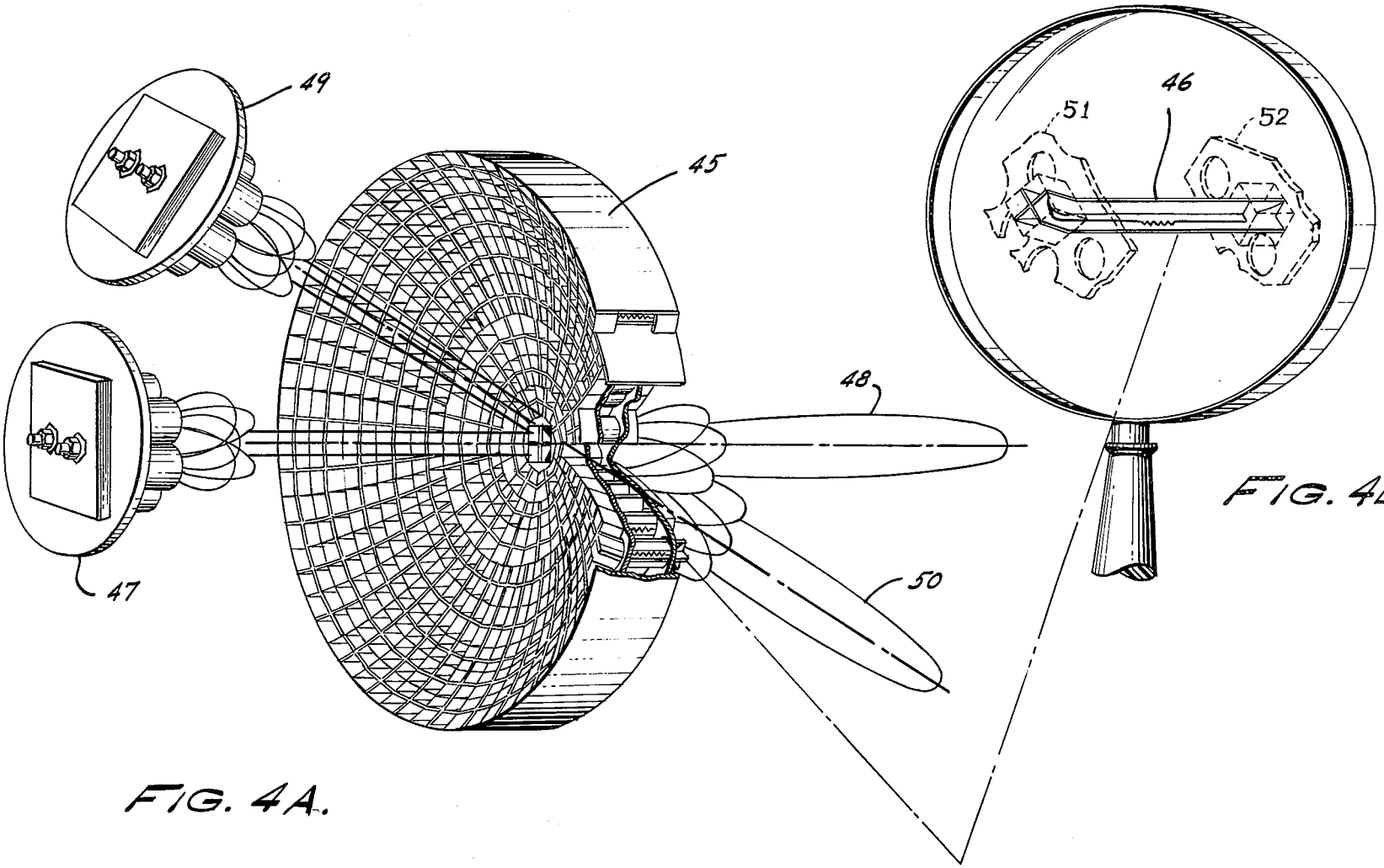
FIG. 4A is a lens constructed from elements similar to those of FIG. 2C.
FIG. 4B is a detailed view of an outer element of the lens of FIG. 4A.

FIG. 4A shows a lens construction 45 having a round configuration. A series of printed circuit card antenna and transmission line sections like the one described in FIGS. 2C an 3 are arrayed in concentric rings. The center element is the shortest and in each successive concentric ring the printed circuit cards are made longer. The face of the lens visible in the drawing is curved or concave while the opposite side is planar or flat. The antennas on the concave side of the lens are all designed to face toward a common center of curvature. This means that only the center printed antenna array elements are straight. All others must be bent at an angle that increases toward the edge of the lens. FIG. 4B shows the shape of one of the assembled pair of cards 46 for use in the outer ring of antennas. Elements 51 and 52 shown in dashed outline constitute the ground plane surfaces associated with the antennas at each end of element 46. Such an element is shown in greater detail in FIGS. 6A and 6B.

In FIG. 4A axial feed assembly 47 is a conentional multi-element phased array feed antenna located on the radius of curvature of lens 45 in front of the lens and centered on the lens axis. The beam from this feed appears as lobe 48 for passing through the lens. A similar non-axial feed antenna 49 produces lobe 50 on the other side at the lens. Thus locating a plurality of feed antennas on one side of lens 45, a plurality of different angled output beams radiate from the other side. In effect a single lens can be used with a number of independent feed antennas.

Figure 5A:
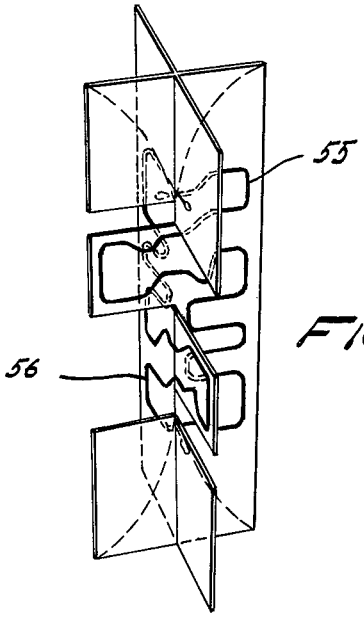
FIGS. 5A and 5B show opposite sides of a central element of FIG. 4A.
Figure 5B:
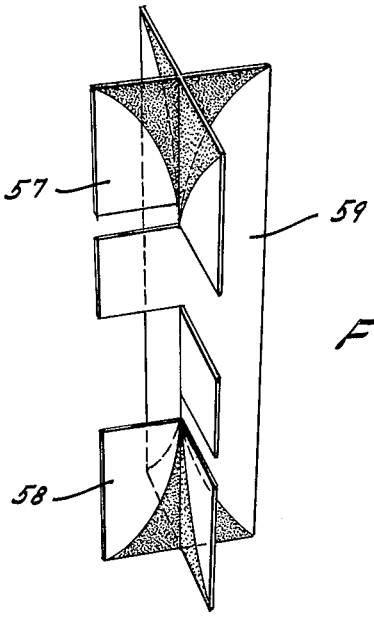

FIGS. 5A and 5B show the detailed construction of the shortest or central lens element of the FIG. 4A lens. In FIG. 5A the microstrip line side of the printed card is shown. The extended meander of microstrip line 55 provides the desired delay interval between the antennas at opposite ends of cards. Meander microstrip line 56 is the same length as 55 and is located on the perpendicular card. FIG 5B shows the antenna and ground plane side of the printed card. Conductor regions 57, 58 and 59 form the antenna and ground plane elements as described in FIG. 2C.

The cards shown in FIGS. 5A and 5B are different from those of FIGS. 2A, 2B and 2C principally in the length of the microstrip line. The extended meander of microstrip lines 55 and 56 are required to obtain a substantial electrical signal delay.

Figure 6A:
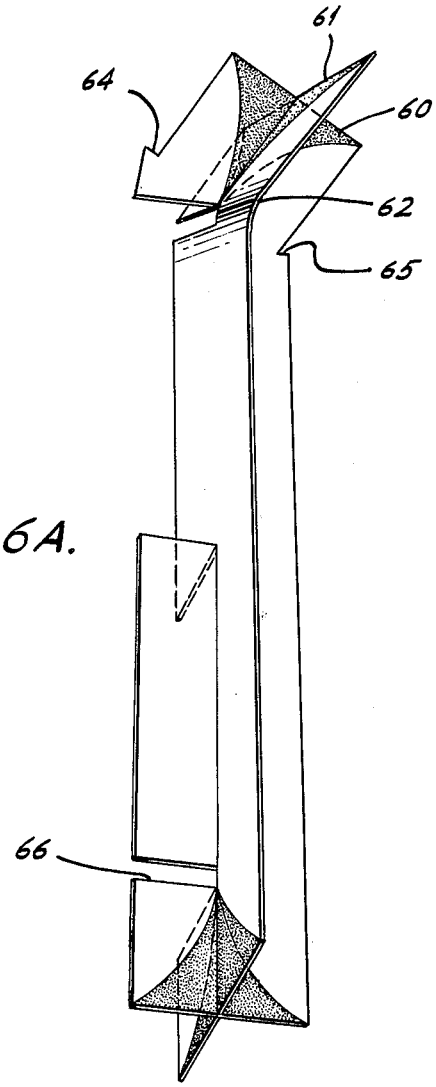
FIGS. 6A and 6B are opposite sides showing the details of the outer lens element of FIG. 4B.
Figure 6B:
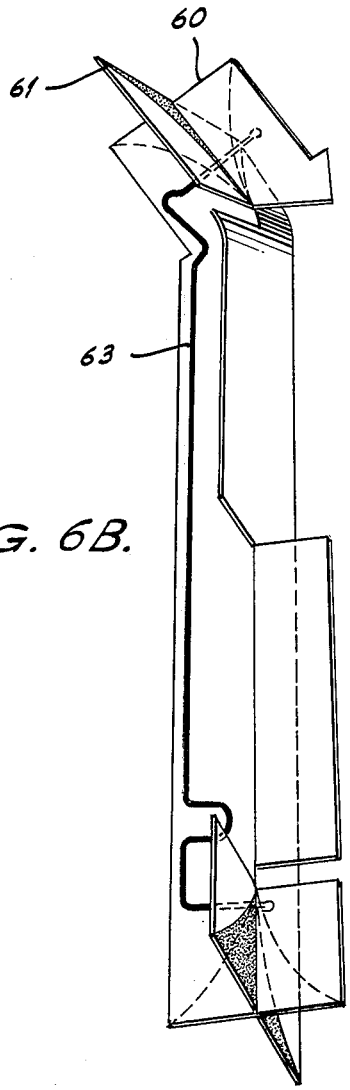

FIGS. 6A and 6B show the detailed construction of the elements in the outer ring of the FIG. 4A lens. It can be seen that one card of the pair, card 60, is printed to provide the correct antenna angle while the end of card 61 is simply bent at 62 to conform to the angle before the cards are cemented together. Notches 64 and 65 act to locate the antenna ground plane position. The notch at 66 locates the ground plane at the other end of the assembly. FIG. 6A shows the antenna and ground plane side of cards, while FIG. 6B shows the microstrip line sides. It will be noted that microstrip 63 is almost straight. However, because of the increased lengths of cards 60 and 61, the total line length is substantially equal to the length of microstrip 55 of FIG. 5A. The other elements in the lens of FIG. 4A will be intermediate in design between the lens elements of FIGS. 5A and 6A.

EXAMPLE

A lens was constructed in accordance with the showing of FIG. 4A. A total of 397 element pairs were arrayed in 12 concentric rings of elements. In construction, the printed cards were prepared and cemented together to form lens elements like those shown in FIGS. 5A, 5B, 6A and 6B. In assembly, the plates 51 and 52 shown in phantom view in FIG. 4B were used to hold the elements in proper spaced relationship. The elements were located in the plates and the ground plane conductors secured with conducting epoxy to fill in the spaces around each element. Then the ground plane shields shown as 41 in FIG. 3 were mounted in place. The open ends of the antenna elements were made about one wavelength across at the design midband. The antenna was about 7 inches thick at the center and about 16 inches thick at the outer edge. The diameter was about 60 inches and the curved face was spherical on a radius of about 60 inches.

This lens operated with up to 19 separate feed positions thereby allowing 19 communications points in an 18° exit cone angle. In a typical example a feed array having 20° half power beamwidth produced an output beam of 3.5° width. The side lobes of the output beam were 30 dB below the main lobe. The low sidelobes were obtained using a Taylor illumination taper distribution, controlled by proper illumination of the elements in the feed cluster.

A new printed wiring antenna has been shown and the application of such an antenna to a passive repeater combination set forth. In addition the assembly of a plurality of such repeaters in to a radiant energy lens has been detailed and an example of such a lens detailed. Clearly other applications and equivalents will occur to a person skilled in the art. Accordingly it is intended that my invention be limited only by the following claims.

I claim:

1. A printed wiring antenna comprising:

at least one insulating substrate sheet having conductors bonded to both faces thereof, a first conductor on a first face of said substrate having a relatively large area almost covering said first face, said first conductor having a tapered notch therein, said notch having a narrow end and increasing divergence toward the other end, said notch extending to have maximum divergence at one edge of said substrate, said maximum divergence being approximately equal to the width of said substrate and approximately equal to one electrial wavelength at the nominal operating frequency of said antenna, whereby the tapered conductors defined by said notch produce broadband antenna action when electrical energy is applied across said narrow portion of said notch, a second conductor on a second face of said substrate contoured to act as a microstrip transmission line, said second conductor extending over said substrate opposite said first conductor which acts as a ground plane thereto to provide microstrip transmission line action, means coupled through said substrate for electrically connecting said line to said first conductor at a point located along said notch and means for applying radio frequency energy between said second conductor and said first conductor.

2. The antenna of claim 1 wherein two of said insulating substrates are mounted together at substantially right angles with said edges of said substrates with said maximum divergence of said notch being located in a common plane, and said means for applying radio frequency energy excites said microstrip line to permit said antenna action to accommodate circular polarization.

3. A printed wiring antenna comprising:

at least one insulating substrate sheet having conductors bonded to both faces thereof, a first conductor on a first face of said substrate having a relatively large area almost covering said first face, said first conductor having a tapered notch at each of two opposing edges of said substrate, each said notch having a narrow end and increasing divergence toward the other end, said notches extending to have maximum divergence at opposing edges of said substrate and a maximum divergence approximately equal to the width of said substrate, whereby the tapered conductors defined by said notches produce broadband antenna action when electrical energy is applied across said narrow portions of said notches.

a second conductor on a second face of said substrate being contoured to act as a microstrip transmission line connecting the narrow portions of said two notches, said second conductor extending over said substrate opposite said first conductor which acts as a ground plane thereto to provide microstrip transmission line action, means coupled through said substrate for electrically connecting each end of said line to said first conductor at a point located along a corresponding one of said notches thereby to provide a passive radiant energy repeater.

4. The antenna of claim 3 wherein two such structures are mounted together at substantially right angles whereby said repeator will accommodate radiant energy of any polarization.

5. The antenna of claim 4 wherein a pair of open faced conductive boxes enclose the antenna structures at opposing edges of said substrates with the plane of the open face of said box occurring at said edges at said maximum divergence of said notches.

6. The antenna of claim 5 wherein a plurality of said passive repeaters are assembled into an array and said microstrip lines are selectively contoured to give said array a lens action.

7. The antenna of claim 6 wherein the individual elements of said plurality are made to have different lengths, said lengths being selected to provide said lens with a selected surface contour.

8. The antenna of claim 7 wherein certain ones of said individual elements are constructed so that when assembled into said selected surface contour all of the edges of said substrate where said maximum divergence of said slots occurs are perpendicular to lines passing through a common point, and antenna feed arrays intended to illuminate said lens are located at or adjacent to said point.

9. A printed wiring antenna comprising:

at least one insulating substrate sheet having conductors bonded to both faces thereof, a first conductor on a first face of said substrate having a relatively large area almost covering said first face, said first conductor having a tapered notch therein, said notch having a narrow end and increasing divergence toward the other end, said notch extending to have maximum divergence at one edge of said substrate, said maximum divergence being approximately equal to the width of said substrate, whereby the tapered conductors defined by said notch produce broadband antenna action when electrical energy is applied across said narrow portion of said notch, an open faced conductive box enclosing said notch, the open face of said box occurring at the edge of said substrate at which said maximum divergence is present, a second conductor on a second face of said substrate contoured to act as a microstrip transmission line, said second conductor extending over said substrate opposite said first conductor which acts as a ground plane thereto to provide microstrip transmission line action, means coupled through said substrate for electrically connecting said line to said first conductor at a point located along said notch and means for applying radio frequency energy between said second conductor and said first conductor.

* * * * *